US005318320A

United States Patent [19]

Ramer

[11] Patent Number: 5,318,320

[45] Date of Patent: Jun. 7, 1994

[54] SNOW SKI BINDING

[75] Inventor: Paul C. Ramer, Golden, Colo.

[73] Assignee: Ramer Products, Ltd., Golden, Colo.

[21] Appl. No.: 841,361

[22] Filed: Feb. 25, 1992

[51] Int. Cl.[5] ..... A63C 9/08

[52] U.S. Cl. ..... 280/614; 280/618; 280/632

[58] Field of Search ..... 280/614, 618, 631, 632, 280/636

[56] References Cited

U.S. PATENT DOCUMENTS

| | | | |
|---|---|---|---|
| 2,545,574 | 3/1951 | French | 280/618 |
| 3,173,701 | 3/1965 | Beyl | 280/626 |
| 3,244,431 | 4/1966 | Hatlapa | 280/614 |
| 4,002,354 | 1/1977 | Ramer | 280/614 |
| 4,417,749 | 11/1983 | Näpflin | 280/614 |
| 4,674,766 | 6/1987 | Ramer | 280/614 |

FOREIGN PATENT DOCUMENTS

| | | |
|---|---|---|
| 2063163 | 6/1972 | Fed. Rep. of Germany . |
| 516319 | 1/1972 | Switzerland . |

*Primary Examiner*—David M. Mitchell
*Assistant Examiner*—Andrew C. Pike
*Attorney, Agent, or Firm*—Gary M. Polumbus

[57] ABSTRACT

A snow ski binding is provided that includes a boot plate which is releasably securable to a ski by a toe piece and heel piece. The boot plate is pivotally connected to the toe piece so as to selectively pivot about a transverse axis and allow a skier to move in a cross-country motion. The heel piece is movable between a plurality of positions to selectively lock the trailing end of the boot plate to the ski to facilitate downhill skiing or can be repositioned to allow the boot plate to pivot about the toe piece while restricting the downward movement of the trailing end of the boot plate between two locations to facilitate use of the binding in a cross-country mode for climbing hills.

5 Claims, 3 Drawing Sheets

SNOW SKI BINDING

BACKGROUND OF THE INVENTION

1. Field of the Invention

The present invention relates generally to bindings for snow skis and more particularly to a binding which is convertible between downhill and cross-country use.

2. Description of the Prior Art

Ski bindings have evolved from a very crude form wherein a strap was used to secure the skier's boot to the ski to more sophisticated bindings which automatically release the skier from the ski once certain relative forces are applied to the skier or ski. These latter bindings have been referred to as safety release bindings and are intended to minimize the risk of injury to the skier. Release bindings have primarily been directed toward Alpine or downhill skiing and have rarely addressed cross-country skiing.

Cross-country skiing has been rapidly increasing in popularity. For years, bindings for cross-country skiing did not vary materially and most have utilized some form of anchor for the toe of the skier's boot while leaving the heel free to lift as occurs in normal walking motions.

The recent increase of interest in cross-country skiing, however, has brought about a need for a binding which is readily convertible between use as a downhill skiing release binding and a cross-country binding. Examples of such bindings can be found in U.S. Pat. No. 4,002,354 issued Jan. 11, 1977 to Paul C. Ramer for SKI BINDING; U.S. Pat. No. 2,686,059 issued Aug. 10, 1954 to Francis Whitaker for SKI HARNESS; U.S. Pat. No. 4,513,988 issued Apr. 30, 1985 to Josef Svoboda for a DEVICE FOR CROSS-COUNTRY SKIING; U.S. Pat. No. 4,392,666 issued Jul. 12, 1983 to Paul C. Ramer for INTEGRAL SKI BINDING; U.S. Pat. No. 4,500,108 issued Feb. 19, 1985 to Luvern Johnson, III, for CONVERTIBLE SKI DEVICE; and French Patent No. 2,490,099 published Mar. 19, 1982.

SUMMARY OF THE INVENTION

The snow ski binding of the present invention consists of a boot plate which is removably securable to the bottom of a ski boot, a toe piece and a heel piece which are securely mountable on a ski to releasably retain the boot plate on the ski. The toe piece and boot plate are substantially identical to that disclosed in my U.S. Pat. No. 4,002,354 issued Jan. 11, 1977 for SKI BINDING. The boot plate has a bail on its forward end adapted to overlie the sole at the front of a ski boot and a releasable overcenter bail at the rearward end that selectively overlies the sole at the heel of the boot so that the boot can be removably secured to the top of the boot plate. The boot plate includes a pair of parallel semi-rigid spring bars which protrude forwardly and are adapted to be releasably seated on opposite ends of a transversely extending pin on the toe piece so that the boot plate can be selectively pivoted about the pin. In this manner, the binding can serve as a cross-country ski binding allowing the heel of the skier's boot to be elevated during walking and gliding motions.

The heel piece of the binding is adapted to selectively overlie a protrusion from the rearwardmost end of the boot plate and selectively secure the boot plate in a parallel relationship with the ski. The heel piece is movable, however, between a plurality of positions so that it is also adapted to release the rearward end of the boot plate to thereby permit the previously described pivotal movement of the boot plate about the toe piece. In two other positions, the heel piece actually underlies the boot plate to prevent the boot plate from returning to a parallel relationship with the ski. When underlying the trailing end of the boot plate, the heel piece facilitates use of the ski for climbing by approximating a generally horizontal orientation for the boot plate even though the ski is inclined up a hill. This has been found to minimize the effort and energy needed for climbing with snow skis as the heel of the user's boot does not need to return beyond horizontal to the ski surface.

The heel piece is uniquely designed and has two operative component members with one of the members being in operative engagement with a compression spring s that it can be yieldingly retained in a first position to either hold the trailing end of the boot plate tightly against the ski in a parallel relationship therewith or underlie the boot plate to define a first level of restricting downward movement of the rearward end of the boot plate. The second operative member of the heel piece is releasably connected to the first member so as to provide means for moving the first member between operative positions by overcoming the bias placed thereon by the compression spring. The second member also serves to underlie the boot plate and define a second position for preventing downward movement of the boot plate. The second position is slightly higher or more elevated than the first position.

Other objects, advantages and capabilities of the present invention will become apparent as the description proceeds, taken in conjunction with the accompanying drawings.

DESCRIPTION OF THE PREFERRED EMBODIMENT

Figure 1:
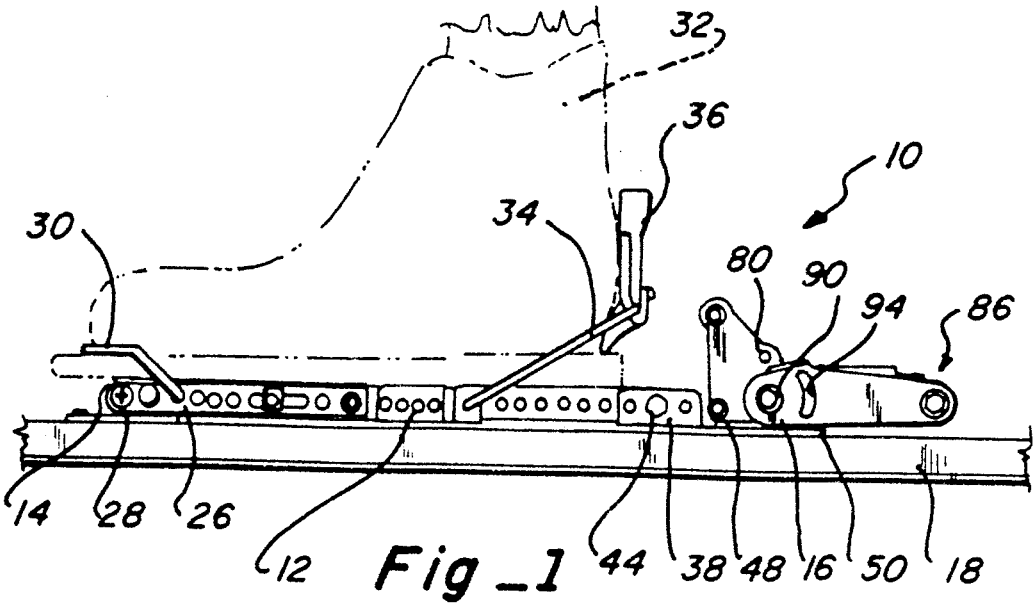
FIG. 1 is a side elevational view of the binding of the present invention shown mounted on a ski and with a ski boot shown in phantom lines positioned thereon.
Figure 2:
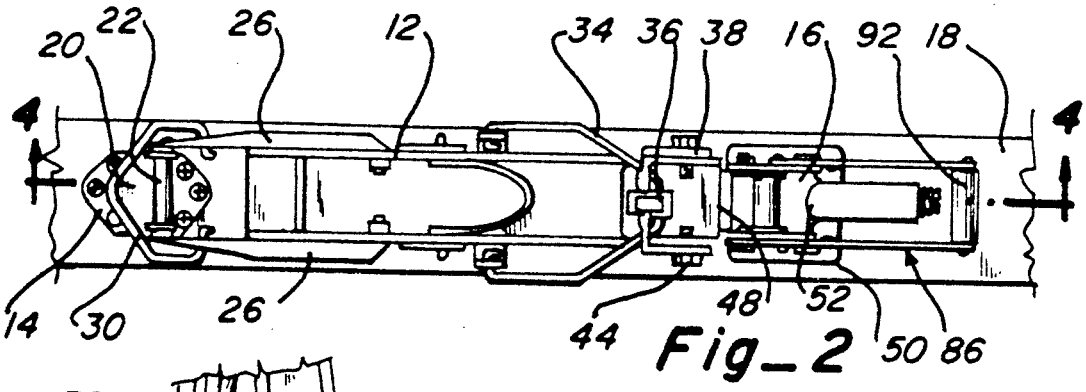
FIG. 2 is a top plan view of the binding of the present invention shown mounted on a ski.
Figure 4:
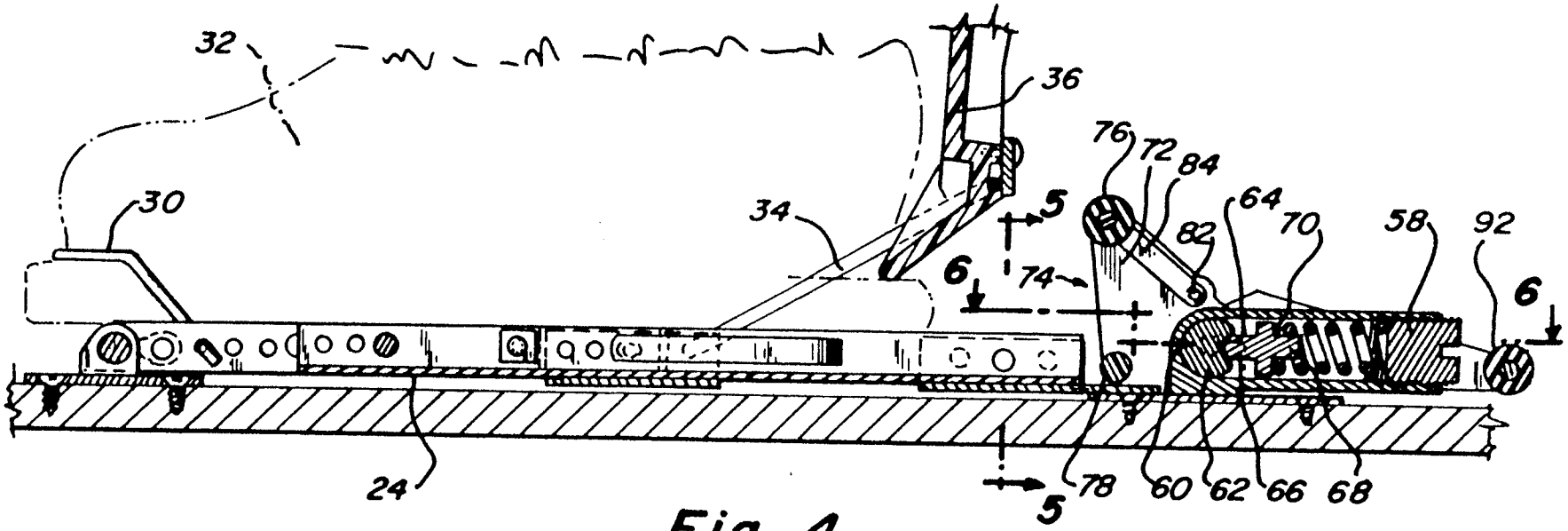
FIG. 4 is an enlarged section taken along line 4—4 of FIG. 2.

Referring first to FIGS. 1, 2 and 4, the snow ski binding 10 of the present invention can be seen to include a boot plate 12, a toe piece 14 and a heel piece 16. The toe piece and heel piece are securable to a ski 18 and releasably retain the boot plate o the ski. As will be described in more detail later, the toe piece 14 is adapted to be releasably and pivotally connected to a leading end of the boot plate 12 while the heel piece 16 is adapted to operatively engage the trailing end of the boot plate so that the boot plate can either be anchored to the ski 1 in parallel relationship therewith or permitted to move in a pivotal manner about the toe piece.

The toe piece 14 and boot plate 12 are substantially similar to the toe piece and boot plate described in my U S. Pat. No. 4,002,354 issued Jan. 11, 1977 for a SKI BINDING and the disclosure in that patent is hereby incorporated by reference. The toe piece 14 can be seen to include a base 20 that is securable to the ski 18 and has supported thereon a transverse pivot pin 22 whose terminal ends are hemispherical and protrude laterally outwardly away from the base 20. The pivot pin establishes a transverse axis about which the boot plate 12 can pivot when the boot plate is releasably attached thereto.

The boot plate 12 has a channel-shaped main body 24 with a pair of forwardly protruding spring bars 26 secured thereto along opposite sides. The spring bars can be secured to the main body at various locations along their length to preset a variable bias on the bars. The forward end of each spring bar 26 has a recess 28 formed therein adapted to releasably receive an associated hemispherical end of the pivot pin 22 on the toe piece. In this manner, the boot plate can be pivoted about the transverse pivot pin on the toe piece but when substantial lateral pressures are applied to the boot plate, the spring bars can flex sufficiently to release the boot plate from the toe piece for safety purposes.

A wire bail 30 is affixed to the spring bars 26 near their leading end and is adapted to overlie the sole of a ski boot 32 at its toe to secure the toe of the ski boot to the boot plate. A releasable bail 34 is secured to the main body 24 of the boot plate near the rearward end of the boot plate and has a conventional overcenter bail-like mechanism 36 for overlying the sole at the heel of the ski boot to releasably secure the heel of the ski boot to the boot plate. As will be appreciated, between the wire bail 30 and the releasable bail 34 a skier can easily attach his or her boots to the boot plate 12.

The rearward end of the boot plate 12 includes a securement member or plate 38 which constitutes a slight modification to the binding described in my aforenoted U.S. Pat. No. 4,002,354. The securement plate 38 includes a channel-shaped member 40 adapted to underlie the rearward end of the main body 24 of the boot plate with side flanges 42 extending upwardly in parallel relationship with the sides of the main body. The securement plate is affixed to the rearward end of the main body 24 by suitable fasteners 44 passed through aligned openings 46 provided in both the sides of the main body and the flanges of the securement plate. There are a plurality of openings 46 in both the main body and the securement plate so that depending upon the openings selected, the securement plate 38 can be positioned longitudinally of the main body at a selected position to accommodate different sized ski boots. The securement plate has a rearward plate-like extension 48 that extends beyond the rearward end of the main body of the boot plate and is adapted to cooperate with the heel piece 16 in a manner to be described hereinafter.

The heel piece 16 is securable to the ski 18 at a location immediately behind the main body 24 of the boot plate 12 and in slightly overlapping relationship with the plate-like extension 48 of the securement plate. The heel piece includes a base plate 50 on which is permanently and integrally mounted an elongated generally tubular and T-shaped housing 52. The T-shaped housing has a first body portion 54 extending longitudinally of the ski and is adapted to receive a compression spring 56. The trailing end of the T-shaped housing 52 is internally threaded and receives an adjustment member in the form of a screw plug 58 that engages the trailing end of the compression spring so that by axial adjustment of the screw plug, the compressive strength of the spring can be adjusted and regulated. A transverse portion 60 of the T-shaped housing is also tubular in configuration and rotatably receives a generally cylindrical shaft 62 having an indentation or recess 64 formed at one location in its cylindrical wall. The recess 64 is sized and configured to mate with a rounded head 66 of a pin 68 which includes a shoulder 70 at its longitudinal center adapted to abut the leading end cf the compression spring 56 so that the compression spring biases the pin 68 against the shaft 62 and, in a particular rotative position of the shaft, into the recess 64 formed in the shaft.

The shaft 62 has fixed to opposite ends thereof, for unitary pivotal movement therewith, a pair of parallel side arms 72 forming part of a first operative member 74 of the heel piece 16. The side arms 72 are substantially triangular in configuration with one apex being secured and keyed to the opposite ends of the shaft 62 and the other apexes receiving and supporting a pair of transversely oriented rigid cylindrical bars 76 and 78 defining engagement surfaces. The cylindrical bars 76 and 78 are secured between the side arms 72 in any suitable manner establishing a fixed spacing between the side arms.

Along an upper side of the triangular side arms 72, a circular opening 80 is provided through each side arm and is adapted to receive a generally cylindrical plug 82 formed on the end of a leaf spring 84 that is anchored to each side arm at opposite ends of the cylindrical bar 76. The plugs 82 are adapted to protrude through the associated side arm but can be depressed against the bias of the leaf spring by applying pressure against the plug. The purpose for the leaf springs and plugs will become apparent with the further description of the heel piece.

A second operative member or component 86 of the heel piece 16 includes a pair of parallel side arms 88 that are also of generally triangular configuration. One end of each side arm 88 is pivotally secured to the shaft 62 as well as the first operative member 74 by threaded screws 90 advanced axially into opposite ends of the shaft. The opposite end of each side arm 88, from its connection to the shaft 62, supports a rigid cylindrical bar or element 92 defining an engagement surface, the cylindrical element 92 bridging the space between the side arms 88. Each side arm has an arcuate slot 94 formed therein in alignment with the opening 80 provided through the associated side arm 72 of the first operative member so as to releasably receive the plug 82 on the end of the associated leaf spring. The plug not only extends through the opening 80 provided in the associated side arm 72 of the first operative member but also through the arcuate slot 94 in the associated side arm of the second operative member to selectively and operatively interconnect the first and second operative members 74 and 86, respectively.

The operation of the heel piece 1 is best illustrated by reference to FIG. 3 and FIGS. 7 through 9. To facilitate a description of the operation, one edge of the side arms 72 of the first operative member has been identified as A.

Figure 3:
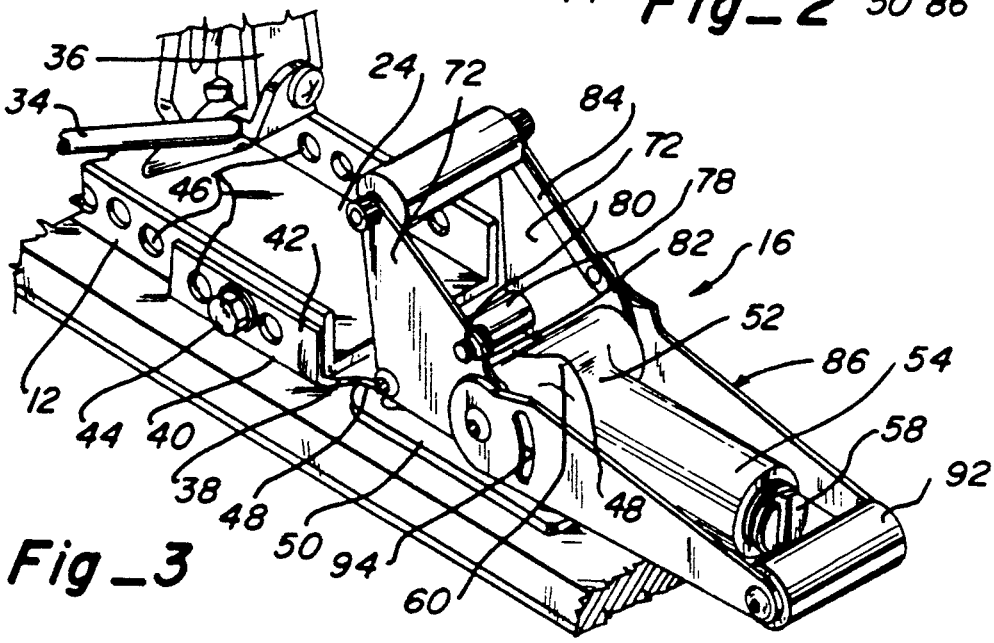
FIG. 3 is an enlarged fragmentary perspective view of a portion of the binding particularly illustrating the heel piece.
Figure 7:
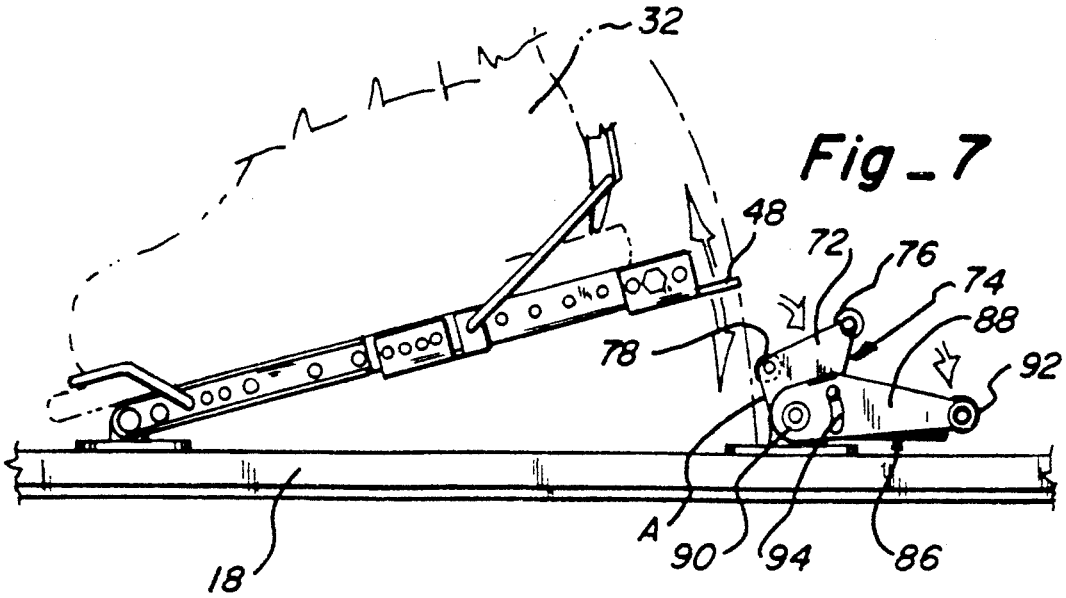
FIG. 7 is a side elevational operational view illustrating the boot plate in a completely freed relationship from the heel piece.
Figure 8:
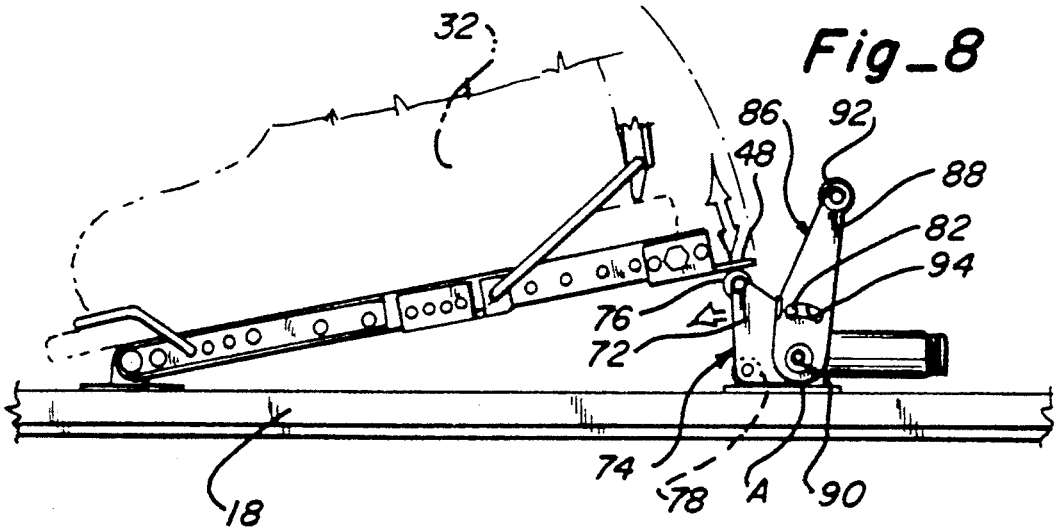
FIG. 8 is a side elevational operational view showing the boot plate and heel piece related such that the heel piece is selectively supportable by a lower engagement surface of the heel piece.

As will be appreciated, the first operative member 74 is movable between a first position, as illustrated in FIG. 8, wherein edge A extends horizontally and in parallel relationship with the ski 18 and a second position as illustrated in FIG. 7 wherein edge A extends substantially vertically or perpendicularly relative to the ski. In the second position of FIG. 7, the trailing end of the boot plate 12 is free to move up and down about its pivotal connection to the toe piece 14 as is desired when the skier is cross-country skiing. The trailing end of the boot plate, however, can be secured adjacent to the ski with the boot plate extending in parallel relationship with the ski by first positioning the boot plate in parallel relationship with the ski and then moving the first operative member 74 from its second position of FIG. 7 to its first position of FIG. 8. In this position, the lower cylindrical bar 78 overlies the plate-like extension 48 from the securement plate 38 on the rearward end of the boot plate. This is best illustrated in FIG. 3. The binding 10 is utilized in this position when a skier is downhill skiing and desires that the heel of his boot be positively secured to the ski as with conventional snow ski bindings. Lateral forces applied to the boot plate 12, however, which cause the boot plate to be released from the toe piece 14 (as described previously) will also release the boot plate from the heel piece 16 since the plate-like extension 48 on the boot plate can slide laterally out from beneath the heel piece or can force the first operative member, against the bias of the compression spring, from its first position to its second position.

In a second mode of operation, the first operative member 74 is moved to its second position as illustrated in FIG. 7 to allow the boot plate 12 to pivot upwardly above the heel piece 16. While the boot plate is elevated, the first operative member can be moved back to its first position of FIG. 8 with edge A extending horizontally and with the first operative member at least partially underlying the plate-like extension 48. As seen in FIG. 8, the plate-like extension limits the downward movement of the boot plate by forcing the boot plate to engage the upper cylindrical bar 76. However, the boot plate is free to pivot upwardly from the position illustrated in FIG. 8. This orientation of the binding is utilized when the skier is climbing a slight incline and it is desired that the boot not be allowed to return completely to the ski or below horizontal when the ski is inclined upwardly at its leading tip. It has been found that this avoids excessive fatigue and saves energy as is important in many backcountry skiing trips.

When climbing even steeper hills, it is sometimes desirable to elevate the point at which the trailing end of the boot plate is prevented from moving downwardly and this is accomplished by moving the second operative member 86 of the heel piece 16 into a forwardly inclined position which is achievable while the first operative component is in the first position with edge A extending horizontally. Since the cylindrical bar 92 at the free end of the second operative member is elevated relative to the upper cylindrical bar 76 on the first operative component, the boot plate 12 is inhibited from moving downwardly at a higher location than when the heel piece is positioned as in FIG. 8. By utilizing the binding as illustrated in FIGS. 8 and 9, depending upon the slope of the hill being climbed, a skier's boot can be restricted to movement between a position with the boot plate engaging one of the cylindrical bars 76 or 92 on the first or second operative members respectively and elevated positions above such engagement.

Figure 9:
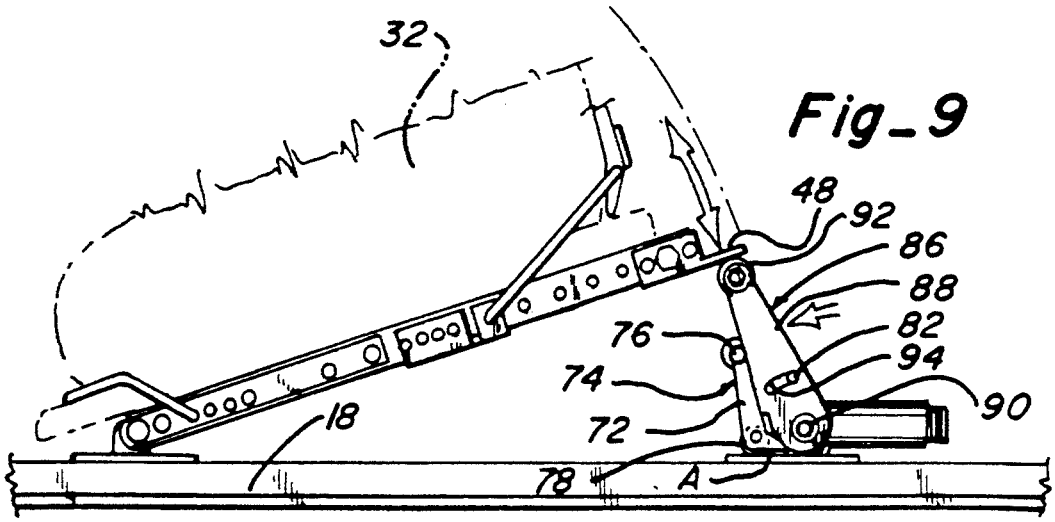
FIG. 9 is a side elevational operational view showing the boot plate related to the heel piece so that the boot plate is selectively supportable by an upper engagement surface of the heel piece.

In summary, the three positions of the heel piece 16 illustrated in FIGS. 7 through 9 are useful when using the binding for cross-country skiing while the position of the binding illustrated in FIG. 3 is useful when the binding is used for conventional downhill or Alpine skiing.

Figure 6:
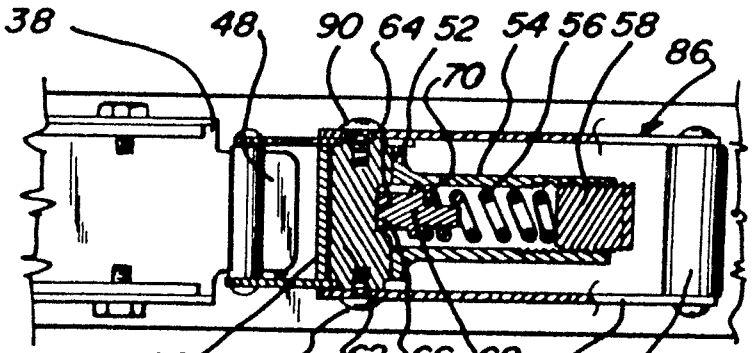
FIG. 6 is a section taken along line 6—6 of FIG. 4.
Figure 5:
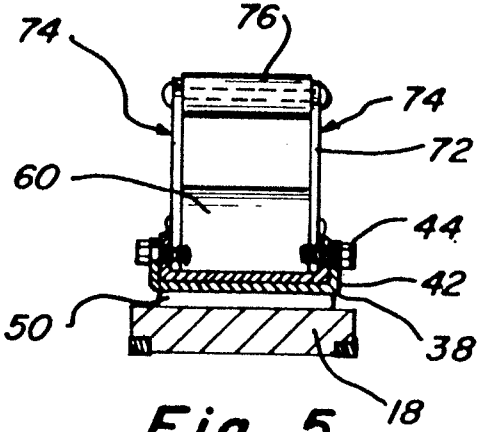
FIG. 5 is a section taken along line 5—5 of FIG. 4.

The heel piece 16 is yieldingly retained in the position shown in FIGS. 4 and 8 by the cooperation of the pin 68 on the compression spring 56 with the recess 64 in the shaft 62. As is seen in FIGS. 4 and 6, the pin 68 is seated in the recess of the shaft when the heel piece 16 is oriented with edge A extending horizontally and it is yieldingly urged to remain in that position due to the compressive force of the compression spring on the pin urging it to remain in the recess. The head 66 of the pin 68, as mentioned previously, is rounded and therefore rotative movement of the shaft 62 will cam the pin rearwardly against the bias of the compression spring and allow the pin 68 to be removed from the recess and merely ride along the cylindrical surface of the shaft when the first operative member 74 is moved into other positions.

The first operative member 74 is moved between its operative positions by the second operative member 86 which is connected thereto at least partially by the plugs 82 on the leaf springs 84 which protrude not only through the side arms of the first operative member but also into the arcuate slots 94 in the side arms of the second operative member. As can be appreciated by reference to FIG. 9, in order to position the first operative member in its first position with edge A extending horizontally, the second operative member is advanced counterclockwise as far as it will go and into a position where it inclines upwardly and slightly forwardly as in FIG. 9. Movement of the second operative member into this position forces the first operative member into its first position by engagement of the plugs 82 with the trailing edges of the arcuate slots 94 thereby forcing the first operative member to move forwardly with the second operative member.

To move the first operative member 74 to its second position of FIG. 7, the second operative member 86 is moved clockwise until the second operative member extends substantially horizontally in a rearward direction as in FIG. 7. Movement of the second operative member in this direction, pulls the first operative member into a position with edge A extending substantially vertically by engagement of the plugs 82 on the leading ends of the arcuate slots 94.

When the first operative member 74 is in its first position with edge A extending horizontally, the second operative member 86 is free to move within the limits of the plugs 82 movements in the associated arcuate slots 94. Accordingly, the second operative member can be moved forwardly into an underlying relationship with the plate-like extension 48 of the boot plate 12 (FIG. 9) or rearwardly into a retracted position that does not underlie the plate-like extension of the boot plate (FIG. 8). If desired, the first operative member can be positioned in its first position of FIG. 8 and the second operative member pivoted clockwise all the way to a horizontal position as illustrated in FIG. 3 by depressing the plugs 82 against the bias of the leaf springs 84 thereby removing the plugs from the arcuate slots 94 and freeing the second operative member from its confined relationship with the first operative component.

It will be appreciated from the description of the snow ski binding 10 of the present invention that the binding can be used for cross-country skiing as well as downhill skiing by selectively manipulating the heel piece 16 so that the boot plate is either free to pivot about the toe piece 14 or restricted in its pivotal movement and releasably latched against the ski 18 in parallel relationship therewith. Further, the heel piece can be used to restrict downward pivoting movement of the boot plate and intercept that movement at two different elevations to accommodate different degrees of uphill climbing when the binding is in a cross-country mode. The binding is also of very light and simple construction so as to be inexpensive to manufacture while providing reliable operation.

Although the present invention has been described with a certain degree of particularity, it is understood that the present disclosure has been made by way of example, and changes in detail or structure may be made without departing from the spirit of the invention, as defined in the appended claims.

I claim:

1. A snow ski binding for releasibly connecting a boot to an elongated ski having a substantially planar upper surface on which the binding is mounted, comprising in combination, a boot plate selectively securable to the boot, toe piece means for pivotally connecting a forward end of said boot plate to said ski such that the boot plate can pivot about the forward end thereof by lifting and lowering a rearward end of the boot plate, and heel piece means for operatively engaging the rearward end of said boot plate to hold said rearward end adjacent to said ski in one position and in a second non-engaging position to allow the rearward end to pivot about said toe piece means, said heel piece means including a first operative member having upper and lower engagement surfaces, said first operative member being mounted for pivotal movement about an axis which is parallel to said upper surface of the ski and transverse to the length of the ski, biasing means biasing said first operative member into a first position wherein said lower engagement surface can overlie and retain said rearward end adjacent to said ski when the rearward end is disposed between said lower engagement surface and the ski and support said rearward end on said lower engagement surface while in said first position when the heel piece means lies between said rearward end and the ski, and a second operative member pivotally mounted on said heel piece means, said second operative member being moveable independently of said first operative member and being operatively connected to said first operative member to move said first operative member between said first position and a second position, said second operative member having an engagement surface disposable above the upper engagement surface of the first operative member, and wherein said second operative member is selectively and independently moveable into a position underlying the rearward end of said boot plate to prevent said boot plate from extending parallel to said ski.

2. The snow ski binding of claim 1 wherein said biasing means is a compression spring and further including a generally cylindrical member that is co-axial with said axis and is mounted for pivotal movement in unison with said first operative member with said generally cylindrical member having a detent in one side thereof, said detent cooperating with said compression spring in yieldingly resisting movement of said first operative member out of said first position.

3. The snow ski binding of claim 2 further including adjustment means for selectively varying a compressive strength of said compression spring.

4. The snow ski binding of claim 2 wherein said detent is a recess formed in said generally cylindrical member and said compression spring includes a rounded member releasably seatable in said recess.

5. The snow ski binding of claim 2 wherein said first operative member includes a pair of side arms, the side arms being interconnected by the first and second engagement surfaces, said side arms being operatively connected to said generally cylindrical member for unitary pivotal movement therewith.

* * * * *